US005529208A

United States Patent [19]

Carstens et al.

[11] Patent Number: 5,529,208

[45] Date of Patent: Jun. 25, 1996

[54] JAR TICKET DISPENSING APPARATUS AND METHOD

[75] Inventors: Dennis L. Carstens; Kent E. Carstens; Howard A. Weisser, all of Columbus; David L. Brezenski, Platte Center, all of Nebr.

[73] Assignee: Technik Mfg., Inc., Columbus, Nebr.

[21] Appl. No.: 366,627

[22] Filed: Dec. 30, 1994

[51] Int. Cl.[6] ..... G07F 11/52

[52] U.S. Cl. ..... 221/155; 221/186; 221/200; 221/212; 221/254; 221/281; 221/296; 221/1

[58] Field of Search ..... 221/200, 212, 221/2, 1, 133, 178, 179, 180, 254, 289, 296, 281, 155, 186, 190; 273/138 A, 144 A, 144 R

[56] References Cited

U.S. PATENT DOCUMENTS

| | | | |
|---|---|---|---|
| 1,065,472 | 6/1913 | Ross | 221/186 |
| 1,412,826 | 4/1922 | Baughman | 221/186 X |
| 2,057,880 | 10/1936 | Collison et al. | 273/138 A |
| 3,054,170 | 9/1962 | Benichasa et al. | 221/212 |
| 3,065,841 | 11/1962 | Stover | 198/30 |
| 3,448,894 | 6/1969 | Modrey et al. | 221/160 |
| 3,637,065 | 1/1972 | Ruscitti | 198/33 |
| 3,863,802 | 2/1975 | Daniels | 221/68 |
| 3,930,595 | 1/1976 | Formanski | 221/212 |
| 5,379,915 | 1/1995 | Hudspeth et al. | 221/281 X |

FOREIGN PATENT DOCUMENTS

| | | | |
|---|---|---|---|
| 2178733 | 2/1987 | United Kingdom | 221/155 X |

*Primary Examiner*—William E. Terrell
*Assistant Examiner*—Dean A. Reichard
*Attorney, Agent, or Firm*—Law Offices of John A. Beehner

[57] ABSTRACT

The present invention includes a jar ticket dispensing apparatus and method for dispensing jar tickets in response to an operator input. The invention includes an enclosed drum for containing the tickets. A support means supports the drum for rotation thereof. The drum is adapted to be rotated by an electric motor or other conventional device. A control means controls the dispensing of tickets in response to an input of money to the apparatus. The tickets are dispensed by rotating the drum causing the tickets contained therein to come into magnetic contact with a plurality of magnets residing on the drum and to be releasably secured thereto. Dispensing occurs when the magnetically attached ticket encounters a stripper which strips the ticket from the magnet. The dispensed ticket falls into a dispensing chute which dispenses the ticket to the operator.

14 Claims, 8 Drawing Sheets

JAR TICKET DISPENSING APPARATUS AND METHOD

BACKGROUND OF THE INVENTION

1. Technical Field

The present invention relates generally to a method and apparatus of dispensing articles from a container. More specifically, it relates to a method and apparatus of dispensing jar tickets.

Currently, many states allow gambling as a means for generating additional revenue to support public services. One of the most popular ways of engaging in this activity is the purchase of tickets of chance wherein the purchaser pays some nominal fee for each ticket with the possibility of obtaining a large payoff. Conventionally, these tickets are sold by businesses over the counter. Recently, however, in an attempt to streamline sales of these tickets, machines have begun to appear which automate the process. One example of such a machine is the TICKET MASTER manufactured by Technik Manufacturing of Columbus, Nebr. This machine is adapted for dispensing "pull tab" tickets. Another popular ticket is referred to as the "jar ticket". These tickets usually are sold in a small bundle of five or ten tickets which are stapled together. Currently, there is no automatic dispensing apparatus adapted to dispense jar tickets. Consequently, there exists a need for such a jar ticket dispensing apparatus.

There are several advantages to dispensing this type of ticket from a machine in addition to the huge savings in labor compared to over the counter sales. One such consideration is the security factor. By using an automatic dispensing apparatus to dispense these tickets, physical access to the tickets by customers or employees is severely limited. Other than when the machine is being refilled, handling of the tickets occurs only when they are dispensed in accordance with the deposit of money into the machine. Historically, it has been common for about 3½% of jar tickets to shrink (theft or count error). Thus, by limiting access, these losses will be greatly reduced.

Another advantage is the accounting which can be accomplished automatically using some type of simple computer based controlling apparatus. Clearly, this is much easier and faster than having to manually count the number of tickets and is obviously considerably more accurate.

Another, possibly somewhat surprising result of an automatic ticket dispensing apparatus is that people tend to purchase more tickets from a machine than if they were purchasing the tickets over the counter. There are several possible reasons for this, including the fact that there is generally little or no waiting to purchase the tickets, the fact that bartenders, the persons from whom over the counter tickets are usually purchased, would rather sell drinks than dispense tickets, and that the machine is not judgmental so the person purchasing the ticket does not need to worry about the opinion the seller may have of him. Thus, total ticket sales may be greater with an automatic dispensing apparatus.

Finally, the entertainment value that can be provided by such a dispensing machine as the tickets are rotated through the drum and dispensed from the machine may also enhance ticket sales. In the preferred embodiment of the present invention, the portion of the housing apparatus enclosing the dispensing apparatus would be constructed of clear acrylic or equivalent so that the purchasers and potential purchasers can view the operation of the machine. Use of the automatic dispensing apparatus of the present invention would not eliminate the need for someone to pay winners over the counter as approximately eighteen percent are winners.

2. Description of the Prior Art

There are no known devices for the automatic dispensing of jar tickets. However, there are numerous prior art devices for automatic dispensing of other articles.

One such example is provided by Stover, U.S. Pat. No. 3,065,841 issued Jan. 5, 1961. Stover discloses a selector-hopper for dispensing bottle caps. A plurality of magnets are distributed around the outer circumference of an enclosure wall which are used to attract the bottle caps. A scraper is provided to remove any caps which have become stacked on a single magnet. The rotation of the disk upon which the magnets are mounted brings the caps into contact with a chute which is operative to scrape the cap off the magnet and into the dispensing chute.

Another example of a prior art dispensing apparatus is provided by Ross, U.S. Pat. No. 1,065,472 issued Jun. 24, 1913. Ross discloses a cigarette dispenser having an intermediate cylindrical member with recesses or pockets therein. As the intermediate member is rotated, the pockets come into contact with the cigarettes, causing one thereof to be received within the pocket. As the intermediate member is further rotated, the pocket passes adjacent a delivery chute, causing the cigarette to be discharged from the pocket.

While these devices may be quite suitable for the dispensing of caps or cigarettes, the dispensing of jar tickets presents special considerations which the present invention addresses. For example, in the dispensing of jar tickets, it is essential that the number of tickets dispensed be counted so that the proper number are dispensed. The present invention addresses these concerns.

Consequently, it is a primary objective of the present invention to provide an apparatus and method of dispensing jar tickets individually.

It is a further objective to provide a jar ticket dispenser capable of dispensing a plurality of tickets one at a time wherein the number dispensed may be carefully monitored.

It is a further objective of the present invention to provide a jar ticket dispensing apparatus capable of automatically dispensing a number of jar tickets in accordance with the monetary value input thereto.

It is a further objective to provide a jar ticket dispensing apparatus having a sensor and controller means operative to sense and account for the number of tickets dispensed therefrom.

It is a further objective of the present invention to have a housing constructed of a material which allows visual observation of the dispensing apparatus while dispensing tickets therefrom.

It is a further objective of the present invention to provide a dispensing apparatus having a housing which is adapted to accommodate a message board for conveying advertising or messages to purchasers or potential purchasers.

It is a further objective of the present invention to provide a dispensing apparatus wherein historical sales data may be saved for remote transmission.

It is a final objective of the present invention to provide a dispensing apparatus which contains an agitator means for agitating the tickets within the dispensing unit so as to provide a more efficient dispensing of tickets therefrom.

SUMMARY OF THE INVENTION

The present invention includes a jar ticket dispensing apparatus and method for dispensing jar tickets in response to an operator input. The invention includes an enclosed drum for containing the tickets. A support means supports the drum for rotation thereof. The drum is adapted to be rotated by an electric motor or other conventional means. A control means controls the dispensing of tickets in response to an input of money to the apparatus. The tickets are dispensed by rotating the drum causing the tickets contained therein to come into magnetic contact with a plurality of magnets residing on the drum and to be releasably secured thereto. Dispensing occurs when the magnetically attached ticket encounters a stripper which strips the ticket from the magnet. The dispensed ticket falls into a dispensing chute which dispenses the ticket to the operator.

DESCRIPTION OF THE PREFERRED EMBODIMENT

Figure 1:
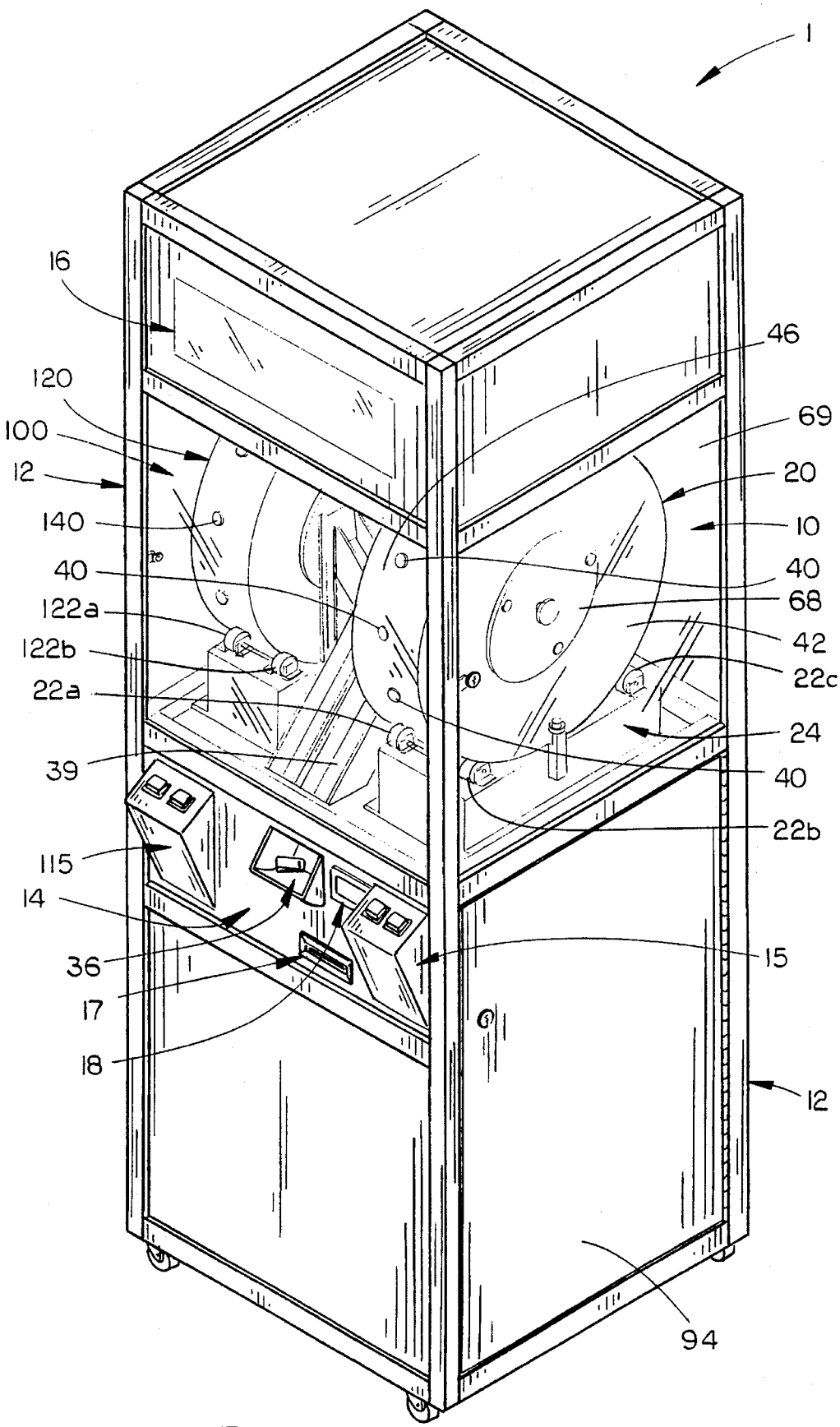
FIG. 1 is a perspective view of the apparatus showing the major components thereof.

FIG. 1 is a perspective view of the jar ticket dispensing apparatus of the present invention 1 shown in housing 12. As seen in the figure, housing 12 is adapted to accommodate two such jar tickets dispensing units 10 and 100 in a side by side fashion. Description herein will generally be limited to a single jar ticket dispensing unit 10 but it will be understood that such a description applies equally well to a second dispensing apparatus. Generally, reference numbers in the figures are assigned as follows: if an element in the first unit 10 is assigned XX, then a similar element in the second unit would be 1XX.

Figure 8:
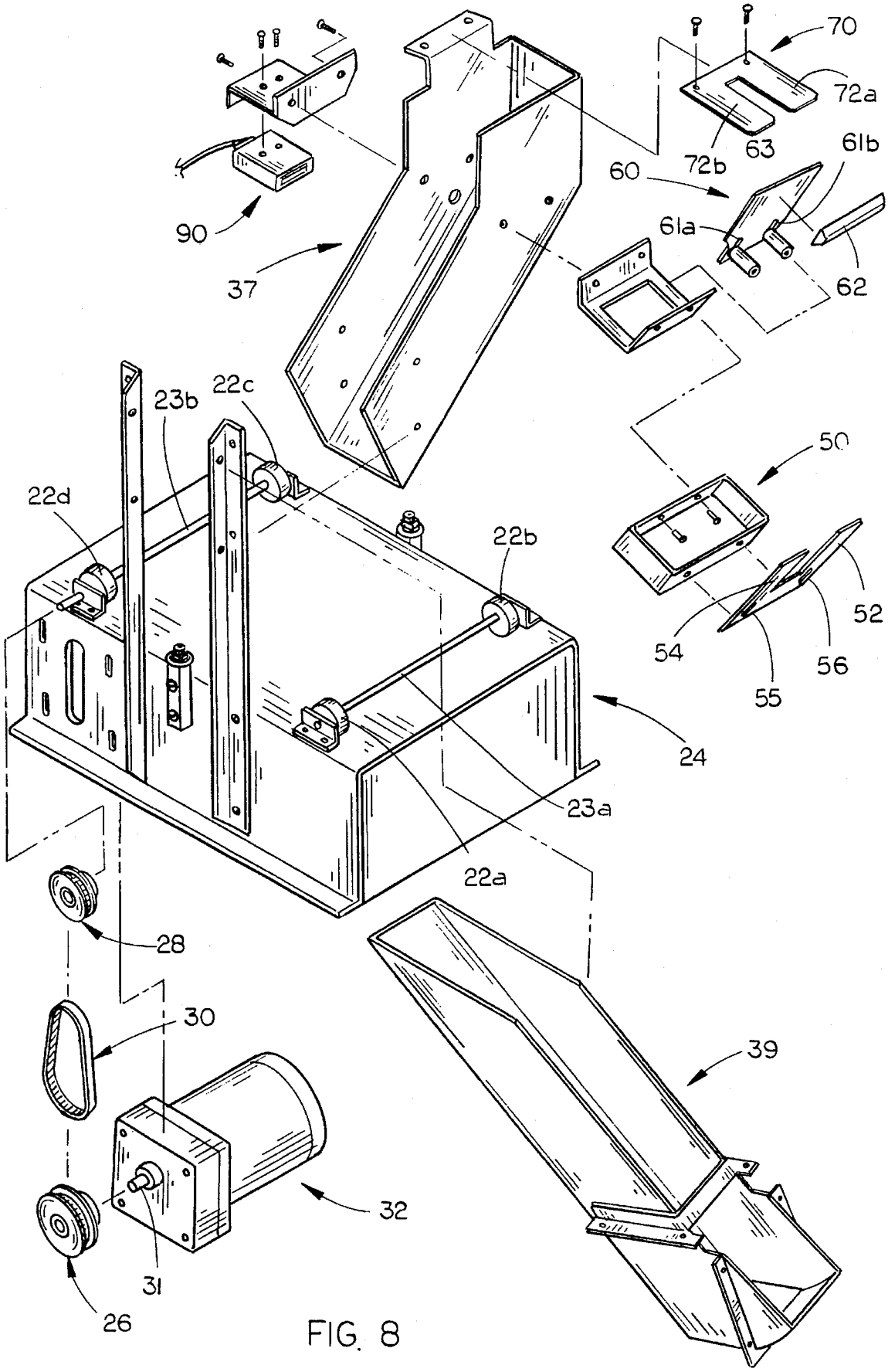
FIG. 8 is an exploded perspective view showing the interconnection of various components.

As seen in the figure, the major components of the dispensing apparatus comprise the ticket enclosure drum 20 in which the plurality of tickets 21 is placed. The drum 20 in turn is placed on a support means. In the preferred embodiment, the support means comprises four support rollers 22*a* through *d*. The front two of these support rollers, 22*a* and *b*, are connected by shaft 23*a*. The front rollers 22*a* and *b* are free willing rollers which turn in response to rotation of drum 20. Conversely, rear rollers 22*c* and *d*, connected by shaft 23*b*, are driven rollers. It is these rear rollers 22*c* and *d* which are responsible for the rotation of drum 20. Alternatively, the support means could comprise a single shaft through the drum and about which the drum would rotate. The drum rotates and tickets are dispensed therefrom in response to a drive means 32 (FIG. 8). In the preferred embodiment, the means 32 for rotating drum 20 is an electric motor but could also be hydraulic or other similar alternatives. Additional details regarding various features of the apparatus are more clearly illustrated in the following figures, the operation of which will be discussed therewith.

Figure 2:
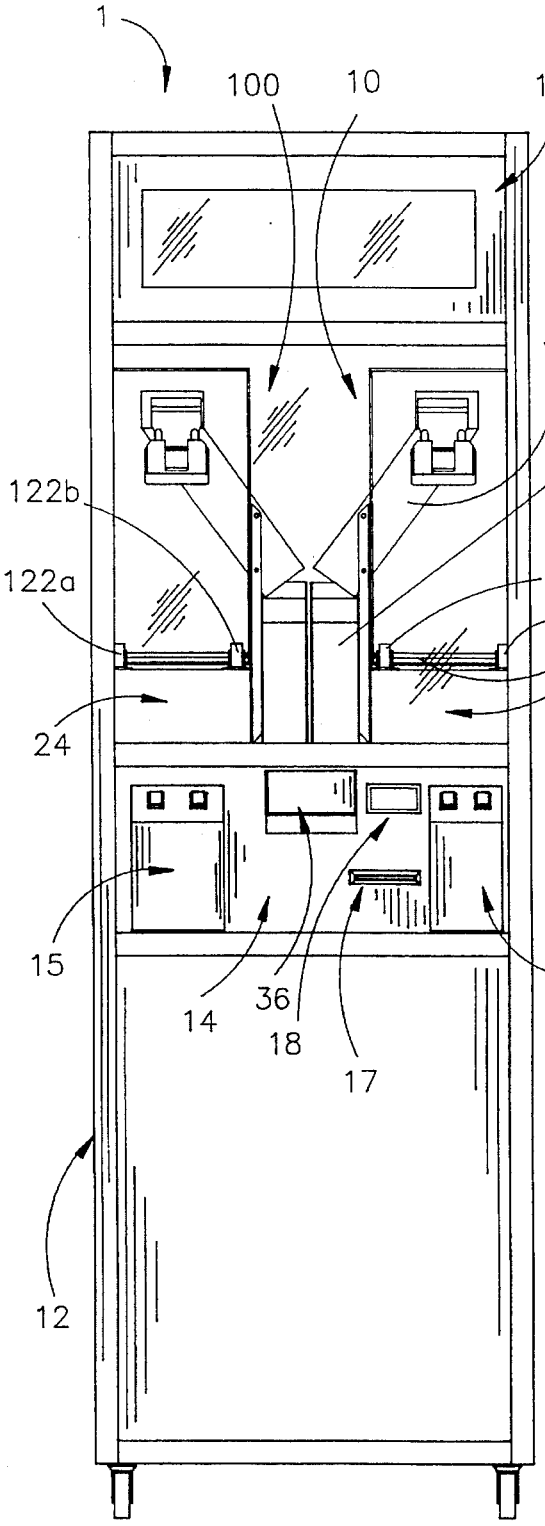
FIG. 2 is a is a front view of the apparatus.
Figure 3:
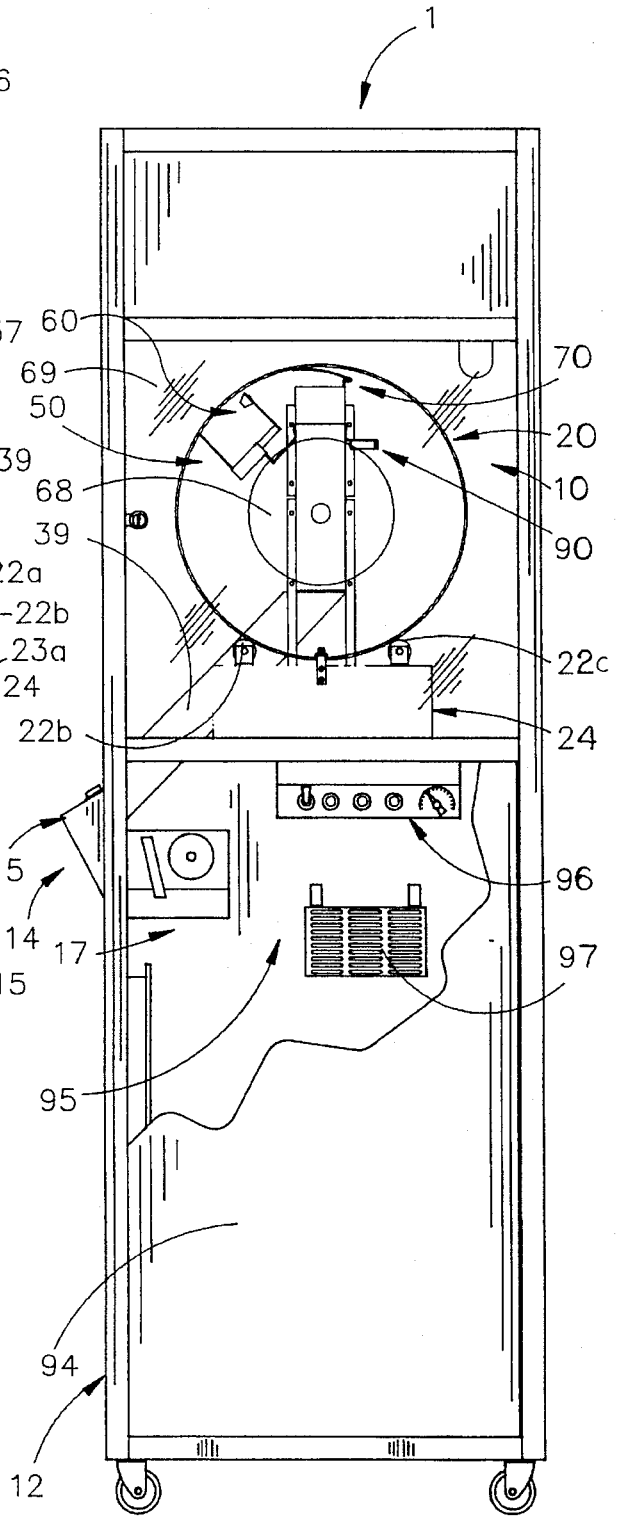
FIG. 3 is a side view of the apparatus showing the lower portion of the cabinet in cut away view illustrating the control means.

FIGS. 2 and 3 are front and side views of the dispensing apparatus respectively. As previously mentioned, the apparatus 1 is designed to accommodate two separate dispensing units 10 and 100 in a single housing 12. This provides additional marketing flexibility since the establishment operating the dispensing apparatus 1 can select two different ticket denominations for dispensing, etc. As seen in the figure, both drums 20 and 120 of units 10 and 100, respectively, are mounted on their respective base frames 24 and 124 with the dispensing chute 38 and 138 positioned therebetween. As is clear in FIG. 2, the dispensing chutes 38 and 138 receive the dispensed tickets in the upper portion of their respective drums 20 and 120 and direct the dispensed tickets toward the center of the housing. Chutes 38 and 138 may empty into a single chute, or may empty into separate chutes 39 and 139. In either case, the dispensed tickets are presented to the operator at a single collection point 36, Control panel 14 is provided for purchasing selections by the user. When, as in the preferred embodiment, the apparatus 1 is adapted to accommodate two dispensing units, means must be provided for controlling the dispensing of the tickets from each unit. In the preferred embodiment, a set of push-buttons 15 and 115 associated with the first and second dispensing units 10 and 100 respectively are provided. The push-buttons 15 and 115 are completely conventional and would serve to identify to the control means 95 such parameters as the number of tickets ordered and otherwise provide the users' interface with the control means 95. In the preferred embodiment, control means 95 is responsible for controlling the dispensing of tickets by controlling the rotation of drum 20. Alternatively, control means 95 could control the dispensing of tickets by controlling the position of dispensing chute 38. For example, if continuous rotation of the drum 20 is desirable for display and entertainment reasons, the control means 95 could alternate the dispensing chute 38 between a display position wherein tickets are dispensed back into the drum, and a dispensing position wherein tickets are dispensed out of the machine to the operator. Control means 95 is discussed below in connection with FIG. 15. In addition to the dispensed ticket collection point 36, control panel 14 also comprises bill collector 17 and amount indicator 18. Both the bill collector 17 and the amount indicator 18 are completely conventional in nature and serve the functions of collecting the currency for purchase of tickets, and the indication of the amount of money input respectively.

As mentioned, it is control panel 14 and associated pushbuttons 15 and 115 which provide user access to control means 95 for normal operating functions such as selection of the number of tickets for purchase. However, there are instances when additional modes or functions such as testing and the like need to be accessed. For these additional modes, an additional control panel 96 is provided. As shown in FIG. 3, access to this control panel is provided by means of locked door 94 in the lower portion of housing 12.

The controller means 95 of the present invention is illustrated in block diagram format in FIG. 15 and discussed below. As mentioned above, the main function of the controller means 95 is to control the dispensing of tickets from the apparatus by controlling rotation of drum 20 allowing tickets to be dispensed in accordance with the amount of money which has been input to the apparatus. This is referred to as the "vend" mode.

In addition to the normal "vend" mode, there are four other modes in which the controller apparatus operates, namely, "price", "count", "motor", and "service" modes. As mentioned, access to these alternate modes is provided through control panel 96 and would normally be limited to the owner of the machines. The "price" mode allows the setting of column pricing which is the amount required to purchase the ticket. The "count" mode which displays the total number of tickets dispensed and the total amount of money which has been accepted. The "motor" mode continuously runs the motor, rotating the drum so that alignment of the various components can be made. Finally, the "service" mode allows the dispensing function to operate, but does not require monetary input. Finally, a "diagnostics" mode is automatically entered upon power of the apparatus. This diagnostic mode conducts a multitude of tests on the system to ensure proper operation of the various components such as sensors and monetary input component and to ensure that the counters are properly set.

In the preferred embodiment, the majority of the electronic components associated with the control means 95 are contained on circuit board 97 also positioned in the lower portion of housing 12.

Message board 16 may be installed on housing 12 to provide information, greetings or any other advertising message desired. Clearly, many different devices may be employed for the message board. In the preferred embodiment, it is a simple "moving dot" display positioned at the top of housing 12 to maximize visibility.

Figure 5:
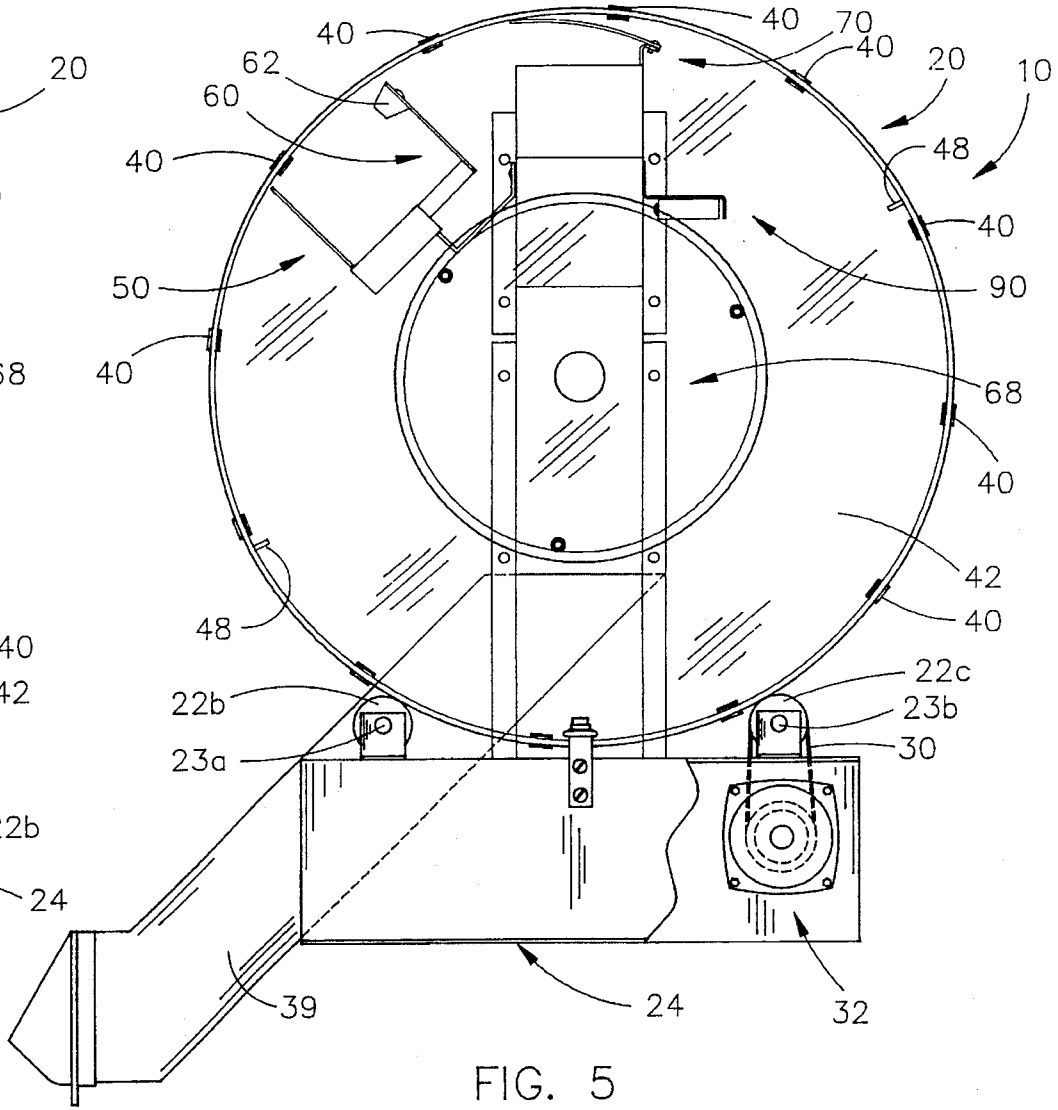
FIG. 5 is a side view of the view presented in FIG. 4 and showing in cut away the mounting base to reveal the drive means.
Figure 4:
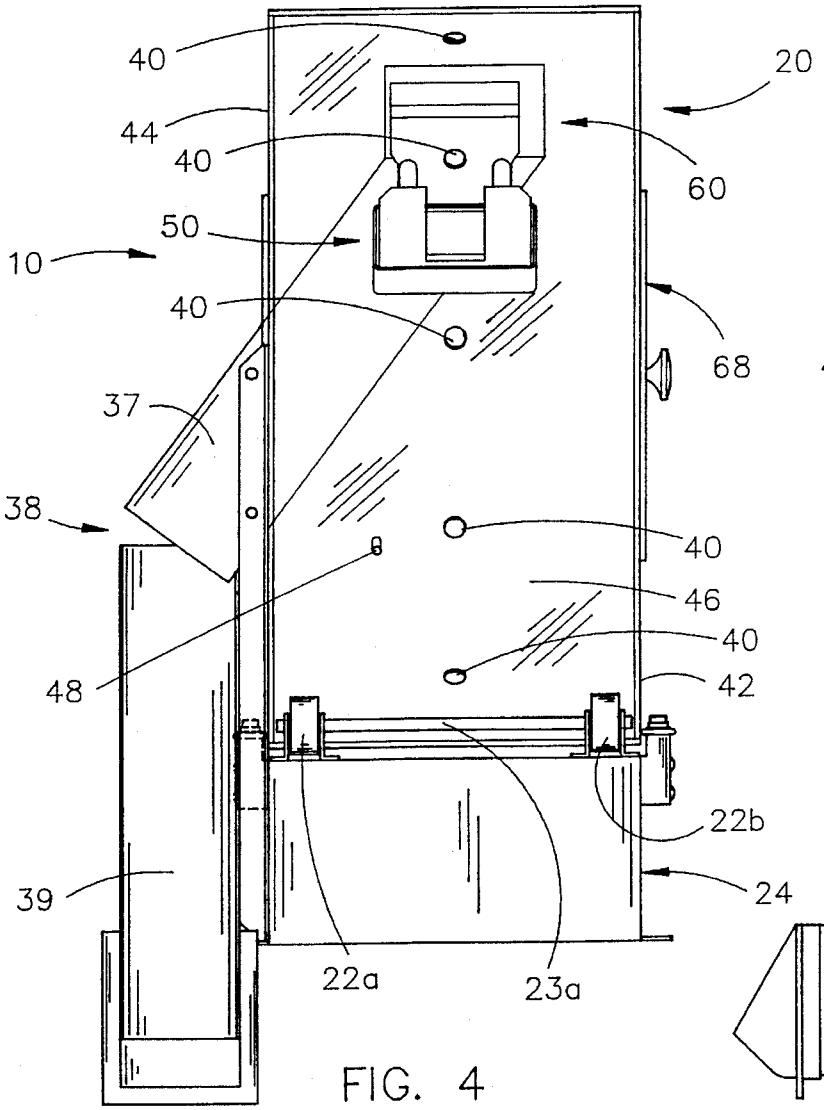
FIG. 4 is a front view showing the drum, its mounting and the dispensing chute.

FIGS. 4 and 5 are front and side views respectively of the drum 20, its mounting on base 24 and associated components of unit 10.

Figure 6:
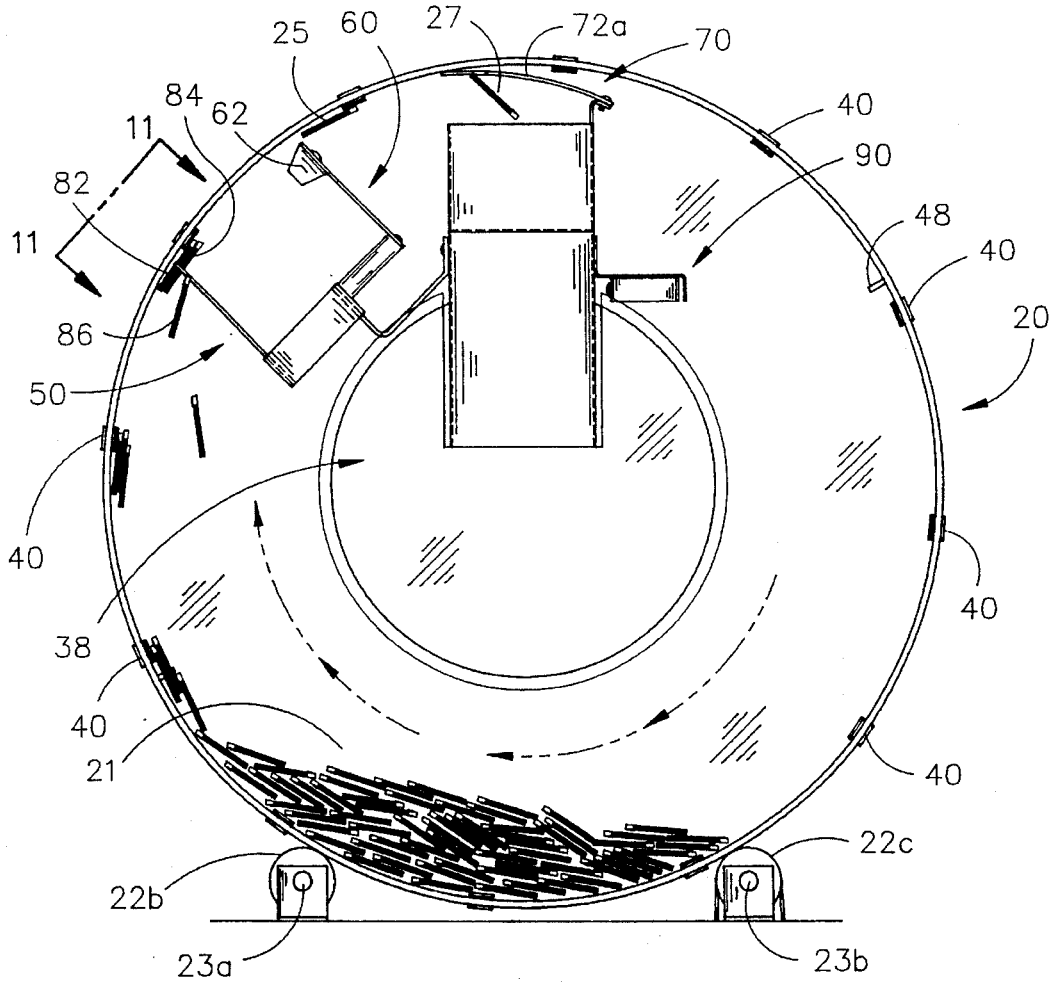
FIG. 6 is a side view of the drum showing the tickets stored therein as well as the vertical an horizontal separators and the ticket stripper.
Figure 7:
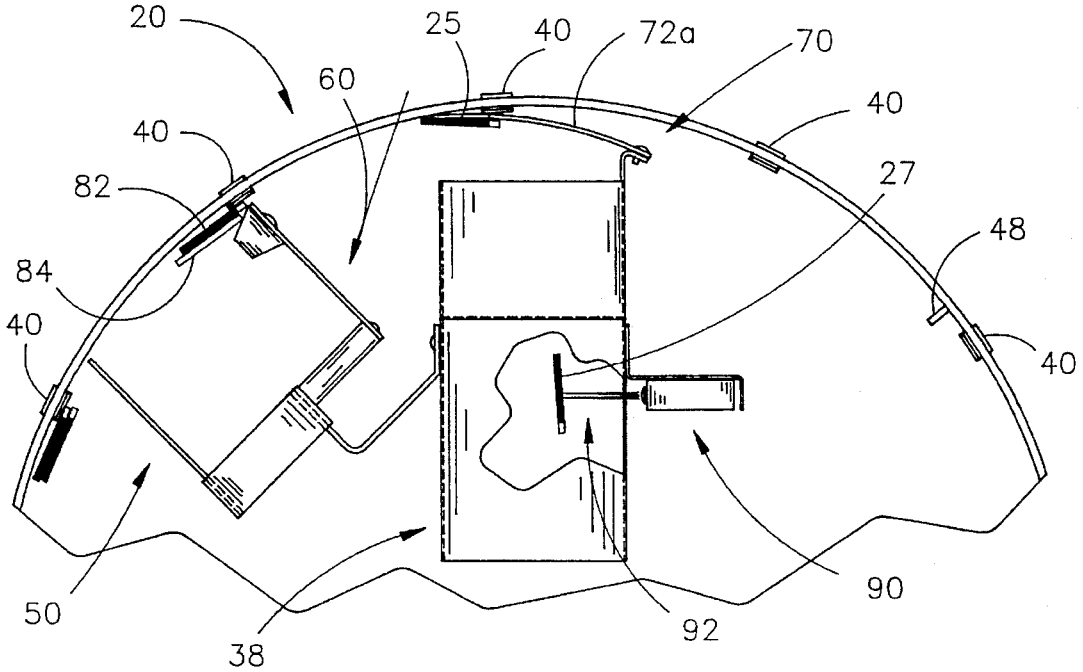
FIG. 7 is an enlarged side view of the drum illustrating in detail the vertical and horizontal separators and the ticket stripper.

The front view of FIG. 4 shows with particular clarity the positioning of the plurality of releasable securement means 40 around peripheral wall 46 on drum 20. In the preferred embodiment, releasable securement means 40 comprises a plurality of permanent magnets. Alternatively, the releasable securement means could be electro-magnets or other suitable alternatives. It is this plurality of magnets 40 which are adapted to magnetically attract the tickets residing in the bottom portion of drum 20 (FIG. 6). This operation is shown in FIGS. 6 and 7 and discussed below. Also shown in FIGS. 4 and 5 are the means for agitating 48. In the preferred embodiment, the means for agitating the tickets comprises a plurality of pegs 48. As seen in this figure, the agitation means 48 are positioned on peripheral wall 46 opposite one another and generally in the central portion of central wall 46 such that the agitation means 48 will come in contact with the tickets residing in the lower portion of drum 20 during the rotation thereof. The purpose of agitation means 48 is twofold. First, they prevent the "bridging" of tickets over the magnets which would preclude their dispensing from the machine. Secondly, they permit the dispensing of the final ticket from the drum which would otherwise tend to float against one of the drum walls. Also shown in the figures is drum door 68 positioned on circular side wall 42 of drum 20. Door 68 provides a means of internal access to drum 20 and thus provides a means for loading tickets therein as well as providing access to components positioned internally of the drum such as the horizontal and vertical separators 50 and 60, the means for dispensing a ticket 70, and the means 90 for sensing a dispensed ticket. Access to drum door 68 is provided by door 69 in housing 12 (FIG. 1). In the preferred embodiment, the means for dispensing a ticket comprises a stripper 70 and dispensing chute 38. FIGS. 4 and 5 also illustrate with clarity the positioning and orientation of dispensing chute 38. As seen in the figures, the upper portion of chute 38 is positioned directly beneath ticket stripper means 70 so that when tickets are stripped from magnets 40, they will fall into chute 38, which is then directed downwardly and outwardly from drum 20. A closable opening 41 (FIG. 9) is provided in side wall 44 of drum 20 for the passage of midsection 37 of chute 38 therethrough. Finally, chute 38 comprises a final portion 39 which is adapted to mate with section 37 and receive the ticket dispensed therefrom. Midsection 37 then conveys the dispensed ticket outwardly and into the dispensed ticket collection point 36 at the front of housing 12 on control panel 14.

The side view presented in FIG. 5 is especially well adapted to illustrate the components residing inside drum 20. For example, the horizontal and vertical separators 50 and 60 as well as the ticket stripper 70 and sensor means 90 are clearly visible in this figure. The operation of these components is discussed in more detail below in connection with FIGS. 6 and 7. Also seen in the side view of drum 20 is the circumferential positioning of magnets 40 around peripheral wall 46 of drum 20 as well as agitation means 48. Finally, the cut away portion of the base 24 in FIG. 5 illustrates the mounting of drum 20 on base 24 and the means for rotating drum 20. As seen in this figure, the drum 20 is positioned so as to sit on rollers 22*a–d*. As mentioned above, the front pair of rollers 22*a* and *b* are "free wheeling" whereas the rear pair of support rollers 22*c* and *d* are the "driven" rollers. As can be seen here and more clearly in FIG. 8 below, the rear, driven rollers 22*c* and *d* are connected to motor 32 by means of drive belt 30. Since the rollers 22*a–d* are constructed of a material, such as rubber, adapted to frictionally engage drum 20, it will be clear that rotation of support rollers 22*c* and *d* is operative to cause the rotation of drum 20 due to the frictional engagement therebetween. As mentioned above, rotation of drum 20 controls the dispensing of tickets therefrom by bringing the tickets into contact with stripper means 70.

FIGS. 5 and 8 are side and perspective views, respectively, of the ticket dispensing apparatus and in particular the base portion 24 thereof showing details of the drive means 32 associated therewith. As seen in this figure, drum 20 rests atop support rollers 22*a–d*. Due to the frictional contact between the rollers and the drum, rotation of the rollers is operative to rotate the drum. As mentioned above, support rollers 22*c* and *d* are referred to as the "drive rollers" since it is these rollers which rotate drum 20. As seen in these figures, drive support rollers 22*c* and *d* are connected by means of shaft 23*b*. As also seen, shaft 23*b* extends outwardly for reception and mounting of drive pulley 28 thereon. Drive belt 30 is used to connect pulley 28 with pulley 26 which is mounted on the shaft 31 of drive motor 32 . Thus, motor 32 is operative to turn drum 20 through the driving of rollers 22*c* and *d*. As seen in these figures, in the preferred embodiment, motor 32 would be mounted below drum 20 in housing 24. Obviously, many other arrangements are possible such as a mounting behind drum 20 or a direct drive of shaft 23*b* by motor 32. The important feature is that some means be provided to rotate drum 20 such that magnets 40 will be brought into contact with tickets 21 residing in the lower portion thereof.

Operation of the apparatus is best seen in FIGS. 6 and 7. FIG. 7 represents a further rotation of drum 20 from the position shown in FIG. 6 and also illustrates a further enlargement of the upper portion thereof. It will be observed from the figures that rotation of drum 20 will bring the magnets 40 into contact with the tickets 21 (FIG. 6) residing in the bottom portion of drum 20. Due to the size and strength of the magnets 40 and since each of the tickets in the pile of tickets 21 residing in drum 20 comprises a metal staple (FIG. 10), there is an extremely high probability that at least one ticket will be magnetically attracted to a magnet 40 as it passes through the pile of tickets 21. Continued rotation of the drum 20 in the direction indicated by arrow 34 (FIG. 6) will bring the ticket or group of tickets magnetically attracted to a magnet 40 in contact with horizontal separator 50. In the event that more than one ticket is attracted to a given magnet, there is a need for a means for separating excess tickets therefrom so that only one ticket is dispensed at a time. In the preferred embodiment the means for separating the excess tickets comprises horizontal separator 50 and vertical separator 60.

The operation of horizontal separator 50 is best illustrated in FIGS. 11–14 below and the details of its operation will be discussed in connection with those figures. It is sufficient here to note that horizontal separator 50 is operative to separate any tickets attracted by magnet 40 which are not in alignment with the direction of motion of the drum 20. Continued rotation of drum 20 next brings the tickets into contact with vertical separator 60.

Vertical separator 60 is positioned such that its upper arm 62 is placed approximately one ticket width away from the peripheral wall 46 of drum 20. Any tickets, in addition to a first ticket, which are attracted to magnet 40, will present a height from the peripheral wall 46 which will bring it in contact with the upper arm 62 of vertical separator 60, causing those tickets to be separated from the magnet. Thus, after passing horizontal separator 50 and vertical separator 60, there should be only one ticket associated with each magnet 40.

It should be noted that in some cases, the horizontal and vertical separators 50 and 60 of the present invention will inadvertently disengage all tickets from a particular magnet due to the entanglements of tickets and the like. This however, is of no consequence, since these tickets will not be dispensed through dispensing chute 38 and consequently will not be counted against the number of tickets to be dispensed. In this case, controller means 95 will simply continue rotation of the drum and consequent further grabbing of tickets until the proper number of tickets have been dispensed therefrom.

Further rotation of drum 20 will next bring magnet 40 and its associated ticket 25 in contact with stripper 70. It will be noted from the figure, that stripper 70 is positioned just above dispensing chute 38. Thus, when stripper 70 strips ticket 25 from magnet 40, ticket 25 will fall into dispensing chute 38 which will carry the ticket to collection point 36 (FIG. 1) where it can be grasped by the operator. The operation of stripper 70 is illustrated in more detail below in FIG. 7. Stripper 70 presents a pair of arms 72*a* and *b* which are positioned against the surface of peripheral wall 46 such that the ticket 25 will be brought into contact with arms 72*a* and *b* as the drum 20 continues its rotation. Thus, arms 72*a* and *b* "scrape" ticket 25 off magnet 40 allowing it to fall into dispensing chute 38. Due to the orientation of dispensing chute 38, the dispensed ticket 27 which has been stripped from magnet 40 will fall into the chute and travel out of the machine to collection point 36 (FIG. 1).

After stripping a ticket from magnet 40, the dispensed ticket 27 is detected by sensor 90. This operation is illustrated in the cut away position of chute 38 shown in FIG. 7. The detection signal from sensor 90 is sent to control means 95. As mentioned above, it is the job of control means 95 to compare the number of tickets to be dispensed with the number which have been dispensed. If the dispensing of ticket 27 does not satisfy the total number to be dispensed, control means 95 will command a further rotation of drum 20. Drum 20 would then continue its rotation bringing another ticket into contact with stripper 70 and the cycle is repeated. If the dispensing of ticket 27 completes the total number of tickets to be dispensed in that cycle, control means 95 would terminate rotation of drum 20 and the dispensing of tickets, by removing power from motor 32.

The operation of vertical separator 60 is also illustrated in FIG. 7. As discussed above, and as seen in FIG. 14, the potential exists for two tickets 82 and 84 to be stacked one on top of the other, in vertical alignment, such that they pass through horizontal separator 50 undisturbed. In this situation, it is necessary to remove the "upper" 84 of the two tickets. In this illustration, ticket 82 is the ticket nearest the wall of the peripheral wall 46 and is the ticket desired to be passed. Conversely, ticket 84 is the excess ticket to be removed. It can be seen from the figure, that if an obstruction is placed in the direction of rotation and in front of ticket 84, that ticket will be separated from ticket 82. This is precisely the design used for vertical separator 60. As seen in the figure, vertical separator 60 comprises a horizontal arm 62 which is placed just slightly more than the thickness of a ticket, away from peripheral wall 46. Slots 61*a* and 61*b* are provided in plate 63 (FIG. 8) for adjustment of plate 63. Since arm 62 is mounted on plate 63, slots 61*a* and *b* provide means for adjusting the proximity of arm 62 to peripheral wall 46. Consequently, arm 62 provides an obstacle to ticket 84 as the drum 20 is rotated. It will be seen that, after passing vertical separator 60, only one ticket 25 should remain attached to magnet 40. Continued rotation of drum 20, next brings the remaining ticket 25 into contact with stripper 70.

Stripper 70 is adapted to disengage the ticket 27 from magnet 40 causing the ticket to drop into the dispensing chute 38. In the preferred embodiment, stripper 70 functions in a manner very similar to vertical separator 60 with the exception that the arms 72*a* and *b* of stripper 70 are placed in contact with the surface of peripheral wall 46. As with the operation of vertical separator 60, continued rotation of drum 20 according to direction arrow 34, brings a ticket into contact with stripper blade 72. Since arms 72*a* and *b* are stationary relative to the rotation of drum 20, continued rotation of drum 20 after contact with arms 72*a* and *b*, will serve to disengage ticket 27 from magnet 40. As seen in this figure, stripper 70 is positioned just above dispensing chute 38. Thus, when ticket 27 has been disengaged from magnet 40, gravity will cause ticket 27 to fall downwardly into dispensing chute 38. As seen from FIG. 1, the orientation of dispensing chute 38 causes the tickets deposited therein to be conveyed out of the machine to collection point 36 where they may be accessed by the operator.

As mentioned above, in the dispensing of jar tickets, it is important that an accurate account be maintained of the number of tickets to be dispensed and the number of tickets which have been dispensed. Thus, it is necessary to have a means for detecting the dispensing of a ticket and conveying that information to a control means. In the preferred embodiment, the dispensing detection is provided by sensor means 90.

As seen from FIG. 7, sensor means 90 is positioned in the upper portion of dispensing chute 38. In the preferred embodiment, sensor 90 is an electric eye, which is operative to transmit a light beam 92 which crosses the opening provided by dispensing chute 38. When a dispensed ticket 27 falls into dispensing chute 38, it breaks the light path 92. Since sensor means 90 is operative to detect such interruptions, it is able to detect the dispensing of a ticket. Once detection of the dispensing of the ticket has occurred, sensor means 90 transmits this information to control means 95. As mentioned above, in the context of dispensing jar tickets, it is important to maintain an accounting of tickets which have been dispensed as contrasted with the number of tickets which are to be dispensed. If the total number of tickets have not yet been dispensed, the rotation of the drum would continue, allowing more tickets to be dispensed therefrom. If the proper total number of tickets has been dispensed from the machine, control means 95 would terminate rotation of drum 20 preventing the release of any additional tickets therefrom. In the preferred embodiment, this counting function and control of the drum rotation is provided by controller means 95.

In the preferred embodiment, controller means 95 is a microprocessor controlled computer having conventional programmable memory I/O communication support. The controller means 95 is operative to receive the operator input of money via control panel 14 and to determine therefrom the number of tickets to be dispensed. Once controller means 95 has made this determination, the controller begins rotation of drum 20 and the dispensing of tickets therefrom. As mentioned above, a plurality of tickets 25 are dispensed according to the manner described above. The rotation of drum 20 and the dispensing therefrom continues until the number of tickets dispensed coincides with the number to be dispensed. At that time, controller means 95 would cease rotation of drum 20.

Figure 9:
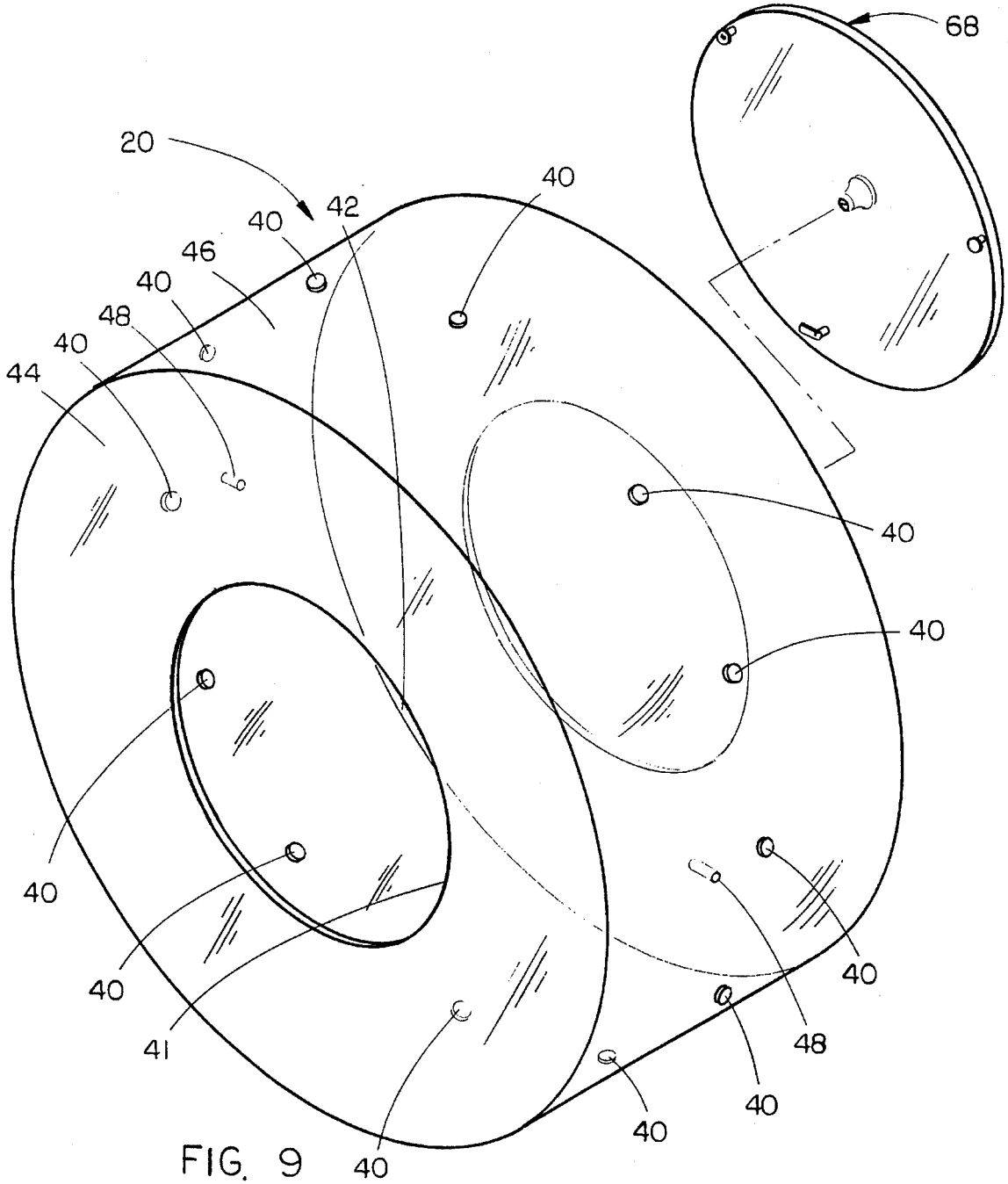
FIG. 9 is an enlarged exploded view of the drum.

FIG. 9 illustrates details of the enclosure drum 20. It will be seen that ticket enclosure drum 20 comprises two circular spaced apart walls 42 and 44 connected by a peripheral wall 46. Access to drum 20 is provided by door 68 which provides a means for loading tickets therein. Access to the drum itself is provided by door 69 in the upper portion of the housing (FIG. 1). A plurality of magnets 40 is disposed along the surface of peripheral wall 46. Additionally, a plurality of agitation means 48 are placed along peripheral wall 46. In the preferred embodiment, these agitation means 48 may be pegs or other objects which project into the drum and are positioned so as to contact the tickets 21 when the drum 20 is rotated.

Figure 10:
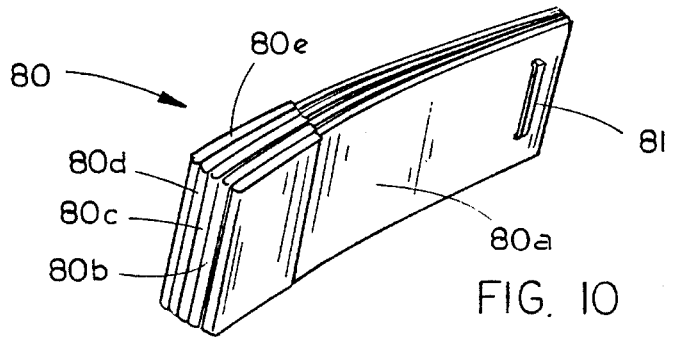
FIG. 10 illustrates one example of a jar ticket which the present invention is designed to dispense.
Figure 13:
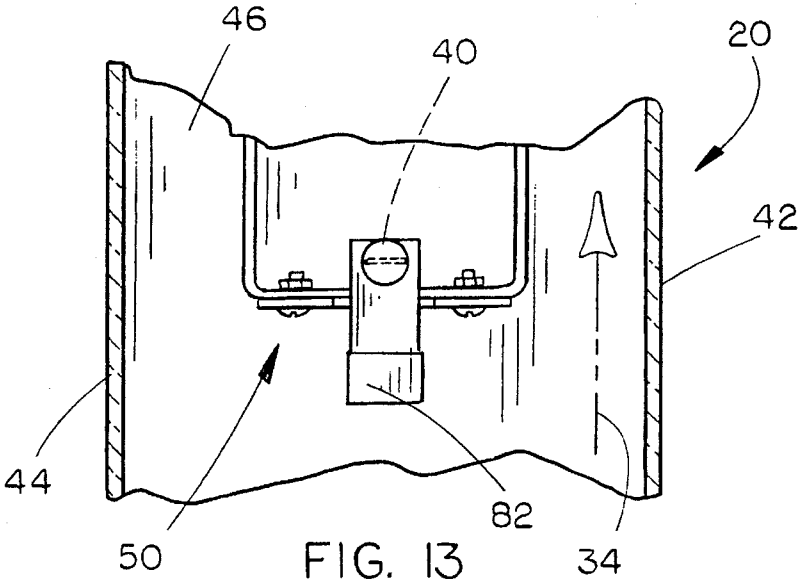
FIG. 13 is a top view showing the correction of the misalignment shown in FIG. 11.

FIG. 10 is a perspective view of a typical ticket 80 which might be dispensed from the present invention. As seen, the ticket generally comprises a plurality of sheets 80*a–e* all of which are held together by means of staple 81. As was discussed above, staple 81 provides a means for the ticket 80 to be magnetically attached to one of the plurality of magnets 40 on drum 20. Obviously, other metallic objects such as paper clips would work equally well.

It is also contemplated that objects other than jar tickets may be dispensed from the dispensing apparatus. For example, folded dollar bills could be dispensed from the apparatus according to the principles described above. The main criteria to be observed is that the article being dispensed would have some type of metal connected thereto so that it might be attracted by magnets 40. Additionally, the size and shape of the horizontal and vertical separators 50 and 60 would have to be modified to accommodate the size and shape of the article being dispensed therefrom.

Figure 14:
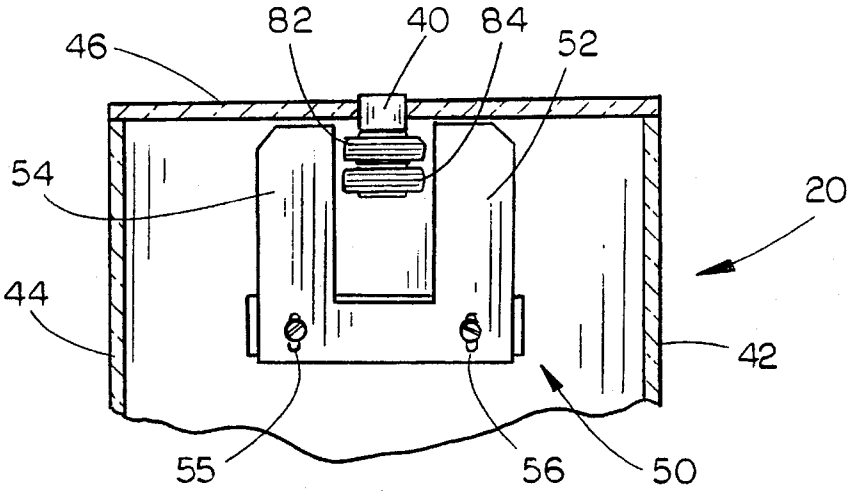
FIG. 14 is a front view of FIG. 13.
Figure 11:
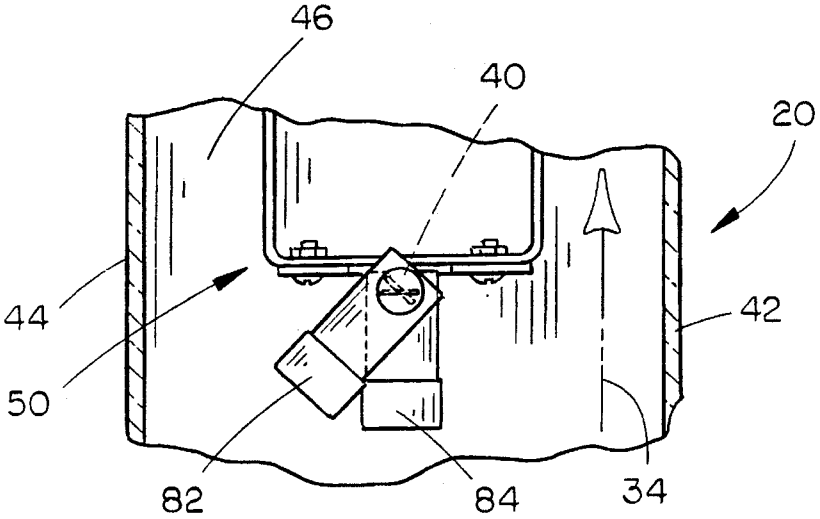
FIG. 11 is a top view of the horizontal separator showing a ticket out of alignment.
Figure 12:
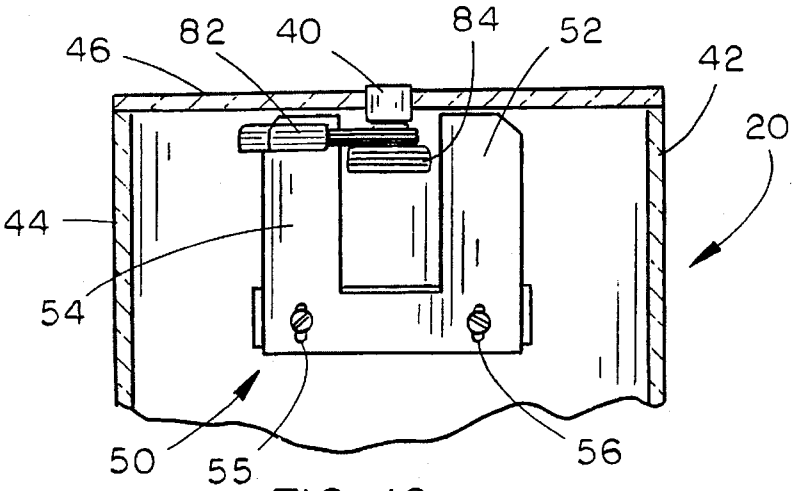
FIG. 12 is a front view of FIG. 11.

FIGS. 11–14 are top and front views of the horizontal separator component 50 of the present invention. As seen in these figures, horizontal separator 50 comprises two side walls 52 and 54 which are aligned with the direction of rotation 34 of drum 20. Horizontal separator 50 also comprises slots 55 and 56 and associated locking pins which are adapted to allow arms 52 and 54 to be slidably adjusted upwardly or downwardly moving the separator 50 closer or further from peripheral wall 46. As discussed above, horizontal separator 50 has two main functions. First, it serves to align tickets with the direction of rotation. For example, it can be seen from the figure that since ticket 82 is pivoted to one side, the ticket body will at some point contact wall 54 of horizontal separator 50. If the pivoting angle were not too large, this misalignment would be corrected resulting in the two tickets being stacked one on top the other. The second function of horizontal separator 50 is to separate tickets having too large a misalignment (FIG. 6). Thus, it will be "broken away from" or "separated" from ticket 82. However, the separation provided by horizontal separator 50 is insufficient to ensure that only one ticket is passed. As mentioned, it is possible that the tickets could be vertically aligned one on top of the other. In that case, the tickets will pass between walls 52 and 54 as seen in FIG. 14, and the upper, extraneous, ticket 84 will be undisturbed. Thus, in addition to horizontal separator 50, there is a need for a means of separating "stacked" tickets. This function is provided by vertical separator 60 discussed above.

As mentioned above, and as seen in FIGS. 1 and 2, the housing apparatus 12 of the present invention is adapted to receive two complete dispensing units within the single housing. In that situation, the second ticket dispensing unit 100 would be placed beside the first ticket dispensing unit 10. As seen from the figures, an additional dispensing chute 138 is adapted to be utilized with the second dispensing machine, delivering the tickets from both machines to the same point 36. As mentioned above, the operation of this second ticket dispensing unit 100 is identical to that described in connection with the first ticket dispensing unit 10. In the preferred embodiment, the controller means 95 would have separate control channels devoted to each of the ticket dispensing units 10 and 100. It is contemplated, that one of the ticket dispensing units would contain tickets of one value and the other dispensing unit may contain tickets of another value.

Figure 15:
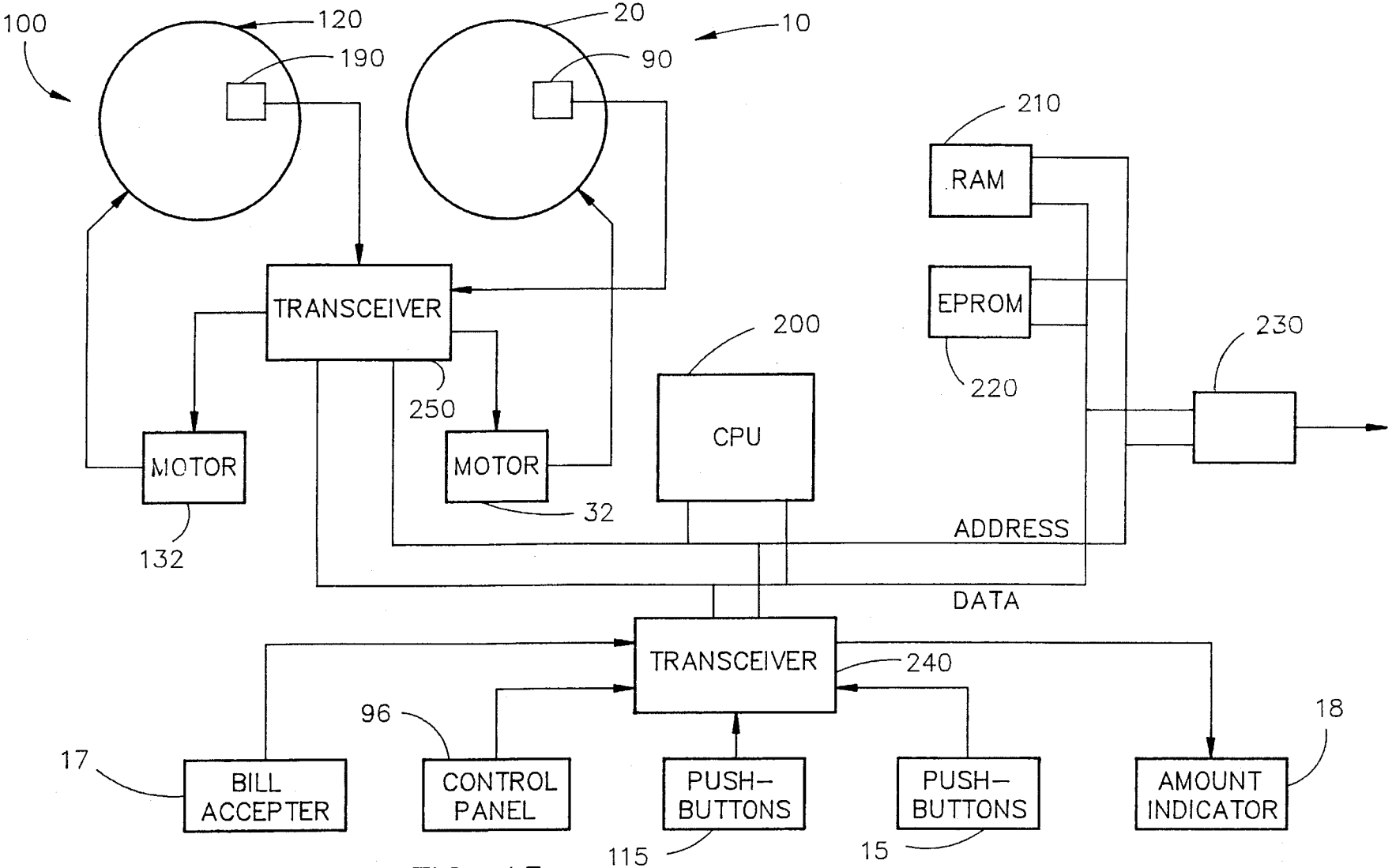
FIG. 15 is a simplified block diagram of the control means of the present invention.

Control means is illustrated in FIG. 15. In the preferred embodiment, control means 95 is a microcontroller. In the preferred embodiment, CPU 200 is a Z-80 but could be any one of many commercially available microprocessors. Control means 95 further comprises conventional RAM and EPROM memory interfaced to CPU 200 in the conventional manner. As is well understood in the art, programming instructions would be contained primarily in EPROM and the RAM would be used to store operational data such as error codes, historical sales information or scratch pad data such as the number of tickets to be dispensed.

Ticket dispensing data is sensed by sensors 90 and 190 as discussed above. This data is forwarded to CPU 200 through a bus transceiver 250 in the conventional manner. As mentioned, CPU 200 maintains a count of the total number of tickets dispensed during the current cycle. This total count is compared to the desired count input from push-buttons 15 or 115. If the total number has not been reached, CPU 200 maintains power to motor 32 or 132. Once the desired total has been reached, CPU 200 removes power from motor 32 or 132. As mentioned above, motors 32 and 132 are operative to rotate drums 20 and 120 respectively. Since rotation of drums 20 or 120 causes tickets to be dispensed therefrom, dispensing of tickets may be controlled by controlling motors 32 and 132. Bill acceptor and amount indicator 18 are interfaced to CPU 200 through transceiver 240 in the conventional manner. As mentioned, bill accepter 17 is operative to receive money into the unit. Amount indicator 18 may be operative to display the amount of money received and the number of tickets to be dispensed. As discussed above, control panel 96, access to which is gained through door 94, is used to command alternate modes of operation such as testing and the like. Finally, a serial communication means 230 may be provided for retrieving information from the CPU 200 and memory 210. For example, it might be desirable for a central location to monitor a day's or week's ticket sales. In that case, the system could be programmed to save the sales information which could then be downloaded by modem at the appointed time.

It is apparent that numerous other modifications and variations of the present invention are possible in view of the above teachings. For example, the housing need not be designed to accommodate two dispensing units. Rather, a single unit or more than two units may be housed. The means for rotating the drum need not be an electric motor. A hydraulic motor or other alternative may be used. Numerous alternatives exist for the separators and releasable securement means. For example, instead of permanent magnets, the releasable securement means could comprise electro-magnets. In that case, the stripper could be eliminated and the power to the magnet simply removed when the ticket was over the dispensing chute, releasing the ticket. Further, numerous alternatives exist for the sensor means in addition to an electric eye. For example, a sensor might be constructed where a magnetic field is disturbed by the ticket staple passing therethrough. Alternatively, a mechanical lever might be placed across the chute which would be tripped by the ticket as it passed down through the chute. Additionally, if continuous rotation of the drum was desirable for display and entertainment reasons, the control means could alternate the dispensing chute between a display position wherein tickets are dispensed back into the drum, and a dispensing position wherein tickets are dispensed out of the machine to the operator.

Therefore, it is to be understood that the above description is in no way intended to limit the scope of protection of the claims and it is representative of only one of several possible embodiments of the present invention.

There has thus been shown and described an invention which accomplishes at least all the stated objectives.

We claim:

1. A jar ticket dispensing apparatus for dispensing jar tickets in response to an operator input, comprising:

an enclosed drum for containing said tickets, the drum having two generally circular, spaced apart side walls and a peripheral outer wall secured therebetween to partially define said drum;

support means for supporting said enclosed drum for rotation thereof;

control means for controlling the rotation of said drum and the number of tickets dispensed therefrom;

means for rotating said drum in response to said control means;

releasable securement means for releasably securing at least one of said tickets to said peripheral outer wall;

means for separating excess tickets from said releasable securement means such that only one of said tickets is releasably secured thereto;

means for dispensing said one releasably secured ticket; and means for sensing a dispensed ticket and communicating with said control means such that tickets are dispensed in response to said operator input.

2. The ticket dispensing apparatus of claim 1 further comprising means for agitating said tickets within said drum.

3. The ticket dispensing apparatus of claim 1 wherein said support means comprises a plurality of wheels atop which said drum is supported for rotation.

4. The ticket dispensing apparatus of claim 1 wherein said control means for controlling the rotation of said drum further comprises a microcomputer adapted to receive operator input of the number of tickets to be dispensed, to interface with said rotation means and said sensing means such that upon operator input of a number of tickets to be dispensed, said microcomputer activates said means for rotating said drum, causing said tickets to be dispensed therefrom and receiving input from said sensing means such that said rotation and dispensing continues until said number of tickets has been dispensed.

5. The ticket dispensing apparatus of claim 1 wherein said means for rotating said drum is an electric motor engaged with said support means such that rotation of said support means is operative to rotate said drum.

6. The ticket dispensing apparatus of claim 1 wherein said releasable securement means is a magnet.

7. The ticket dispensing apparatus of claim 1 wherein said releasable securement means comprises a plurality of magnets positioned along said peripheral outer wall.

8. The ticket dispensing apparatus of claim 1 wherein said means for separating excess tickets comprises first and second separators positioned adjacent said releasable securement means, said first separator adapted to separate tickets not in alignment with the direction of rotation of said drum and said second separator adapted to separate tickets more than one ticket width distant from said peripheral outer wall.

9. The ticket dispensing apparatus of claim 1 wherein said means for dispensing said releasably secured ticket comprises a stripping means for stripping said ticket from said releasable securement means and a dispensing chute positioned internally of said drum and below said stripping means such that a ticket released from said releasable securement means drops into said chute for delivery to said operator.

10. The ticket dispensing apparatus of claim 1 wherein said means for sensing a dispensed ticket is an electric eye.

11. The ticket dispensing apparatus of claim 1 wherein one of said generally circular spaced apart side walls comprises a closable opening therein whereby a supply of tickets for dispensing may be placed therein.

12. The ticket dispensing apparatus of claim 1 wherein said drum is clear so as to permit visual observation of the dispensing of tickets therefrom.

13. A method of dispensing jar tickets from a ticket dispenser comprising:

providing in a ticket dispensing apparatus;

drum for enclosing said tickets and having a plurality of releasable securement means positioned circumferentially around said drum;

delivery chute;

controller means for receiving an operator input and controlling the number of tickets dispensed in response thereto;

inserting said tickets into said apparatus;

initiating the dispensing of tickets by inputting an amount of money into said apparatus;

rotating said drum allowing said tickets to be releasably secured to said releasable securement means;

separating said releasably secured tickets such that only one of said tickets is releasably secured to each of said means;

dispensing a ticket by disengaging said ticket from said releasable securement means such that said ticket falls into said delivery chute;

sensing said dispensing of said ticket;

communicating said dispensing to said controller means; and continuing said dispensing until a number of tickets responsive to said operator input has been dispensed from said apparatus.

14. A jar ticket dispensing apparatus for dispensing jar tickets in response to an operator input, comprising: 'an enclosed drum for containing said tickets, the drum having two spaced apart side walls and a peripheral outer wall secured therebetween to partially define said drum;

support means for supporting said enclosed drum for rotation thereof;

control means for controlling the number of tickets dispensed therefrom;

means for rotating said drum;

releasable securement means for releasably securing at least one of said tickets to said peripheral outer wall;

means for separating excess tickets from said releasable securement means such that only one of said tickets is releasably secured thereto;

means for dispensing said one releasably secured ticket; and means for sensing a dispensed ticket and communicating with said control means such that tickets are dispensed in response to said operator input.

* * * * *